US006568403B2

(12) United States Patent
Hampl, Jr. et al.

(10) Patent No.: US 6,568,403 B2
(45) Date of Patent: May 27, 2003

(54) PAPER WRAPPER FOR REDUCTION OF CIGARETTE BURN RATE

(75) Inventors: Vladimir Hampl, Jr., Roswell, GA (US); Larry D. Snow, Alpharetta, GA (US); Tom Kraker, Alpharetta, GA (US)

(73) Assignee: Schweitzer-Mauduit International, Inc., Alpharetta, GA (US)

( * ) Notice: Subject to any disclaimer, the term of this patent is extended or adjusted under 35 U.S.C. 154(b) by 0 days.

(21) Appl. No.: 09/882,812

(22) Filed: Jun. 15, 2001

(65) Prior Publication Data

US 2002/0026948 A1 Mar. 7, 2002

Related U.S. Application Data

(60) Provisional application No. 60/213,313, filed on Jun. 22, 2000.

(51) Int. Cl.[7] ..... A24D 1/02; D21H 27/00

(52) U.S. Cl. ..... 131/365; 131/360; 162/139; 162/181.1; 162/181.8

(58) Field of Search ..... 131/365, 360; 162/139, 181.1, 181.8

(56) References Cited

U.S. PATENT DOCUMENTS

| | | | |
|---|---|---|---|
| 3,744,496 | A | 7/1973 | McCarty et al. |
| 4,225,636 | A | 9/1980 | Cline et al. |
| 4,318,959 | A | 3/1982 | Evans et al. |
| 4,411,279 | A | 10/1983 | Martin et al. |
| 4,420,002 | A | 12/1983 | Cline |
| 4,453,553 | A | 6/1984 | Cohn |
| 4,461,311 | A | 7/1984 | Mathews et al. |
| 4,480,644 | A | 11/1984 | Luke |
| 4,502,282 | A | 3/1985 | Kanesaka |
| 4,503,118 | A | 3/1985 | Murakami et al. |
| 4,548,677 | A | 10/1985 | Schneider et al. |
| 4,615,345 | A | 10/1986 | Durocher |
| 4,622,983 | A | 11/1986 | Mathews et al. |
| 4,725,318 | A | 2/1988 | Minayoshi et al. |
| 4,732,748 | A | 3/1988 | Stewart et al. |
| 4,739,775 | A | 4/1988 | Hampl, Jr. |
| 4,779,631 | A | 10/1988 | Durocher et al. |
| 4,805,644 | A | 2/1989 | Hampl, Jr. et al. |
| 4,881,557 | A | 11/1989 | Martin |
| 4,924,888 | A | 5/1990 | Perfetti et al. |
| 4,984,589 | A | 1/1991 | Riedesser |
| 4,986,285 | A | 1/1991 | Radzio et al. |
| 4,998,543 | A | 3/1991 | Goodman et al. |
| 5,017,864 | A | 5/1991 | Kaida et al. |
| 5,060,674 | A | 10/1991 | Brown |
| 5,060,675 | A | 10/1991 | Milford et al. |
| 5,074,321 | A | 12/1991 | Gentry et al. |
| 5,103,844 | A | 4/1992 | Hayden et al. |
| 5,105,835 | A | 4/1992 | Drewett et al. |
| 5,107,866 | A | 4/1992 | Aronoff et al. |
| 5,109,876 | A | 5/1992 | Hayden et al. |
| 5,143,098 | A | 9/1992 | Rogers et al. |
| 5,144,967 | A | 9/1992 | Cartwright et al. |
| 5,152,304 | A | 10/1992 | Bokelman et al. |
| 5,156,719 | A | 10/1992 | Passaretti |
| 5,161,551 | A | 11/1992 | Sanders et al. |
| 5,168,884 | A | 12/1992 | Baldwin et al. |
| 5,170,807 | A | 12/1992 | Kasbo et al. |
| 5,172,708 | A | 12/1992 | Drewett et al. |
| 5,215,734 | A | 6/1993 | Kunesh et al. |
| 5,227,025 | A | 7/1993 | Kunesh et al. |
| 5,228,464 | A | 7/1993 | Owens, Jr. |
| 5,253,660 | A | 10/1993 | Dixit et al. |
| 5,263,500 | A | 11/1993 | Baldwin et al. |
| 5,263,999 | A | 11/1993 | Baldwin et al. |
| 5,271,419 | A | 12/1993 | Arzonico et al. |
| 5,302,437 | A | 4/1994 | Idei et al. |
| 5,307,823 | A | 5/1994 | Jones et al. |
| 5,327,916 | A | 7/1994 | Jones et al. |
| 5,360,023 | A | 11/1994 | Blakley et al. |
| 5,385,158 | A | 1/1995 | Owens, Jr. |
| 5,404,890 | A | 4/1995 | Gentry et al. |
| 5,417,228 | A | 5/1995 | Baldwin et al. |
| 5,450,862 | A | 9/1995 | Baldwin et al. |
| 5,450,863 | A | 9/1995 | Collins et al. |
| 5,730,840 | A | 3/1998 | Hampl, Jr. et al. |
| 5,820,998 | A | 10/1998 | Hotaling et al. |
| 5,878,753 | A | 3/1999 | Peterson et al. |
| 5,878,754 | A | 3/1999 | Peterson et al. |
| 5,888,348 | A | 3/1999 | Hampl, Jr. |
| 5,893,372 | A | 4/1999 | Hampl, Jr. |
| 5,921,249 | A | 7/1999 | Hampl, Jr. |

FOREIGN PATENT DOCUMENTS

| | | | |
|---|---|---|---|
| EP | 447094 | A1 | 9/1991 |
| EP | 513985 | A1 | 11/1992 |
| EP | 533423 | A1 | 3/1993 |
| EP | 791688 | A1 | 8/1997 |
| GB | 2028832 | A | 3/1980 |

*Primary Examiner*—Steven P. Griffin
*Assistant Examiner*—Dionne A Walls
(74) *Attorney, Agent, or Firm*—Dority & Manning, P.A.

(57) ABSTRACT

A method of reducing the burn rate of a smoking article is provided. Specifically, the burn rate is reduced by incorporating into a paper wrapper of the smoking article a filler (e.g., precipitated calcium carbonate) having a median particle size greater than about 2.5 microns. For instance, such paper wrappers formed according to the present invention typically have a Diffusion Conductance Index (DCI) of less than about 15 $cm^{-1}$ and a Static Burn Rate (SBR) of less than about 5 millimeters per minute.

35 Claims, 3 Drawing Sheets

PAPER WRAPPER FOR REDUCTION OF CIGARETTE BURN RATE

RELATED APPLICATIONS

The present application is based upon a provisional application filed on Jun. 22, 2000 having U.S. Ser. No. 60/213,313.

BACKGROUND OF THE INVENTION

Smoking articles, such as cigarettes, cigars, and the like, are conventionally made by wrapping a column of tobacco in a wrapping paper. At one end, the smoking article may, for example, include a filter through which the article is smoked. Filters can be attached to a smoking article using a tipping paper that is glued to the white wrapping paper. The wrapping papers and tipping papers used to construct smoking articles are typically made from flax or other cellulosic fibers and contain a filler, such as a calcium or magnesium compound.

Besides being used to hold the cigarette together and to provide the cigarette with an aesthetic appearance, wrapping papers also contribute to or control many physical properties or characteristics of the cigarette. For instance, wrapping paper can be used to adjust the tar delivery per puff, burn rate, puff count, etc. Wrapping paper can also be used to limit the amount of smoke that emanates from the lit end of the cigarette when it is left burning. Further, wrapping paper is even used to reduce the tendency of cigarettes to ignite surfaces which come into contact with the cigarette and to cause the cigarette to self extinguish when left unattended (i.e., ignition proclivity).

One particularly important aspect of the smoking article that can be controlled by the wrapping paper is the smoking article burn rate. For example, a low burn rate can help reduce the ignition proclivity of a smoking article. Moreover, a slower burn rate may also satisfy consumers who desire a smoking article, such as a cigarette, to burn at a relatively slow rate so that an optimum puff count can be achieved.

Recently, due to economic reasons, smoking articles have begun to be produced with lesser amounts of tobacco or with expanded tobacco that is less dense than conventional tobacco, and thus, less costly on a volume basis. However, one significant problem with utilizing less tobacco or expanded tobacco is that the burn rate of the smoking article is significantly increased.

To reduce the burn rate of these or other smoking articles, various techniques have traditionally been utilized. For instance, traditional techniques for lowering the burn rate include decreasing the permeability of the paper wrapper, decreasing the level of burn additive (e.g., citrate), as well as decreasing the filler or chalk level in the paper wrapper. However, in certain instances, it may not be possible or desirable to use these traditional techniques. For example, these techniques may have an adverse affect on other properties of the wrapper.

Thus, a need currently exists for a method of decreasing the burn rate of a smoking article without adversely affecting other characteristics of the resulting smoking article.

SUMMARY OF THE INVENTION

The present invention is generally directed to a method for modifying the paper structure to control the burn rate of a smoking article. In one embodiment, for example, the burn rate of the smoking article is reduced by incorporating into the paper a filler having a median particle size larger than about 2.5 microns.

Any filler material may generally be used in the wrapper of the present invention. Such fillers may include, for instance, calcium carbonate, titanium dioxide, magnesium carbonate, magnesium oxides and the like. For example, one suitable calcium carbonate filler can be obtained from Specialty Minerals, Inc. of Adams, Mass., under the tradename ADX 7014, which is a precipitated calcium carbonate material having a median particle size of 3.5 microns.

In addition, the amount of filler added to the paper generally depends upon the desired permeability, opacity, and the particle size of the filler used. Of particular advantage, however, the desired burn rate levels can generally be obtained without substantially modifying conventional filler levels. Thus, for most applications, the total filler level in the paper can be from about 20% by weight to about 45% by weight, and particularly from about 20% by weight to about 30% by weight.

As stated, a filler having a certain median particle size is incorporated into the paper wrapper to reduce the burn rate of the smoking article. For instance, the filler typically has a median particle size of greater than about 2.5 microns. By utilizing fillers with such particle sizes, the burn rate can be significantly reduced.

In particular, paper wrappers of the present invention typically have a Diffusion Conductance Index (DCI) value less than about 15 $cm^{-1}$, and in some embodiments, between about 5 $cm^{-1}$ to about 15 $cm^{-1}$. Moreover, the Static Burn Rate (SBR) of the smoking articles made with paper wrappers of the present invention can be less than about 5.0 millimeters per minute, and in some embodiments, less than about 4.0 millimeters per minute. In addition, it is believed that the paper wrappers of the present invention can provide up to about a 75% reduction in the burn rate of a smoking article as compared to an identical smoking article made with a paper wrapper having a lower filler particle size (e.g., 1.9 microns) at approximately the same permeability, basis weight, burn control additive level, and filler level. For instance, in one embodiment, a paper wrapper of the present invention can provide between about a 5% to about a 20% reduction in the burn rate of a smoking article as compared to an identical smoking article made with a paper wrapper having a lower filler particle size but having the same permeability.

In some embodiments, a paper wrapper of the present invention can also be coated in discrete regions of an ignition-reducing solution to further reduce the burn rate of the paper. In one embodiment, for instance, an aqueous film-forming solution, such as acidified sodium alginate or a cellulosic polymer dissolved in a non-aqueous solvent, can be applied to certain portions of the paper wrapper. The ignition-reducing solution may generally be applied to the wrapper using conventional techniques, such as gravure or flexographic printing. Moreover, the solution can also be applied in a variety of discrete patterns, such as in the shape of bands, crosshatch, ramped, irregular shapes, and the like.

As indicated above, such a reduced burn rate can provide a number of benefits to the resulting smoking article. For instance, a reduced burn rate can reduce the propensity of the smoking article to ignite surfaces or articles with which they contact (i.e., ignition proclivity). In addition, because such a reduced burn rate also results in an increased puff count, smoking articles formed according to the present invention may also appease consumers who desire that the smoking article have an optimum puff count.

Further, it has been discovered that paper wrappers formed in accordance with the present invention can achieve the benefits described above without severely affecting other properties of the smoking article, such as tar delivery, taste, sidestream smoke, and the like. Moreover, it has also been discovered that the desired burn rate reduction can be achieved at relatively low permeabilities, e.g., less than about 60 CORESTA (wherein "CORESTA" is defined as the flow of air through a web per unit area of the web at a pressure differential of 1 centibar).

Other features and aspects of the present invention are discussed in greater detail below.

BRIEF DESCRIPTION OF THE DRAWINGS

A full and enabling disclosure of the present invention, including the best mode thereof to one of ordinary skill in the art, is set forth more particularly in the remainder of the specification, including reference to the accompanying figures in which.

Figure 1:
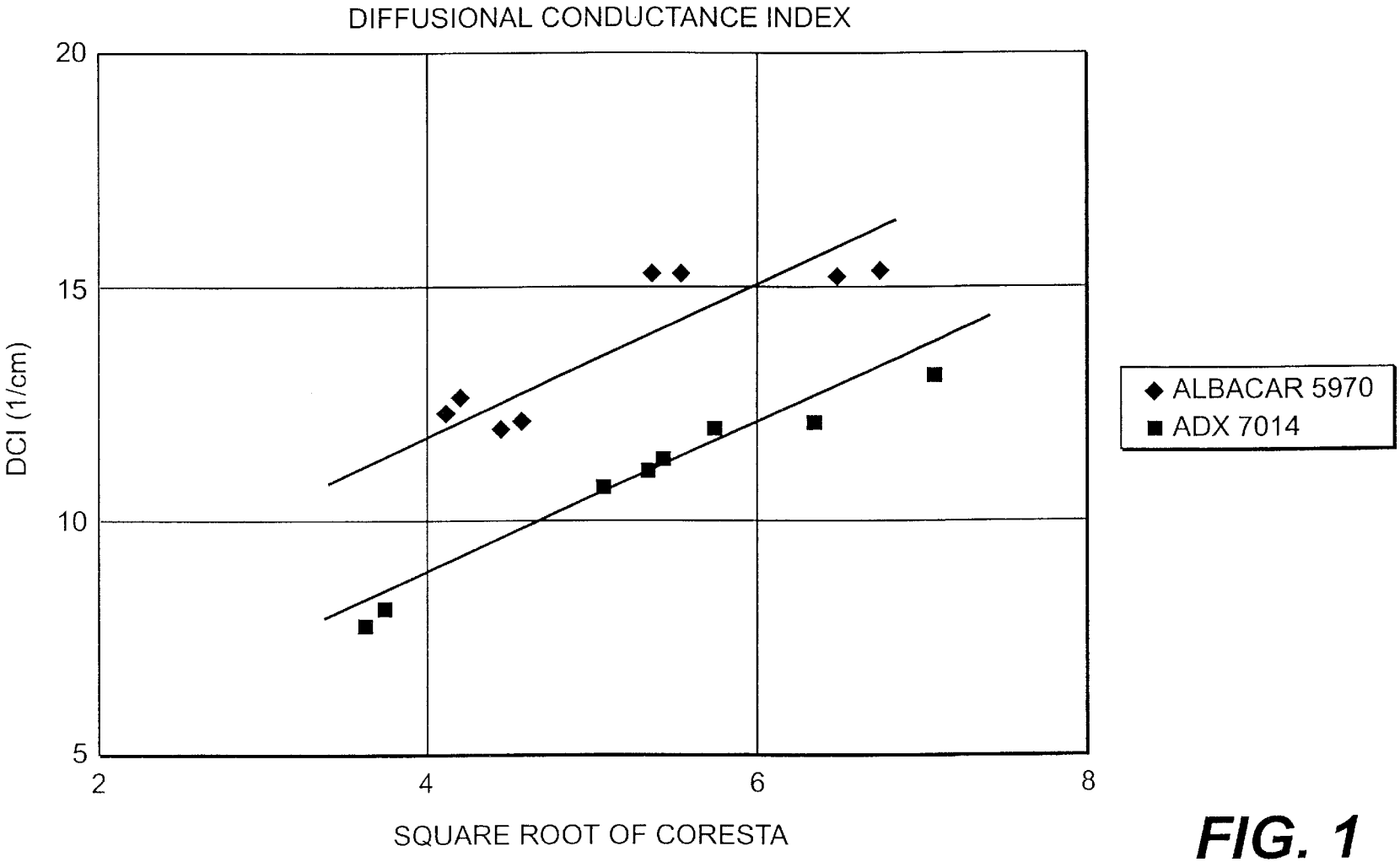
FIG. 1 is a graphical illustration of the Diffusion Conductance Index (DCI) values for one embodiment of a paper wrapper of the present invention.

Repeat use of reference characters in the present specification and drawings is intended to represent same or analogous features or elements of the present invention.

DETAILED DESCRIPTION OF REPRESENTATIVE EMBODIMENTS

Test Methods

"Diffusion Conductance Index (DCI)": The DCI is a test based on the discovery that a wrapper's resistance to the flow of an electric current correlates very well with the ability of the wrapper to support combustion of a cigarette. To determine the DCI (also known as the burn mode index) of a paper wrapper, the test method described in U.S. Pat. No. 4,615,345 to Durocher, which is incorporated herein in its entirety by reference thereto for all purposes, can be utilized. In particular, the wrapper is first generally immersed in a non-aqueous solution of an electrolyte and then placed between two electrodes. The ratio of the intrinsic resistivity of the electrolyte solution (ohm-cm) to the product of the electrical resistance of the paper (ohm) and the area of paper in contact with both electrodes ($cm^2$) is defined as the DCI, a direct measure of a wrapper's ability to support combustion of cigarettes. This electrical resistance can be measured as a series resistance with an impedance bridge, such as Model 1658 manufactured by GenRad Corporation, using an alternating voltage at a 1 Khz frequency applied across the electrodes.

Figure 3:
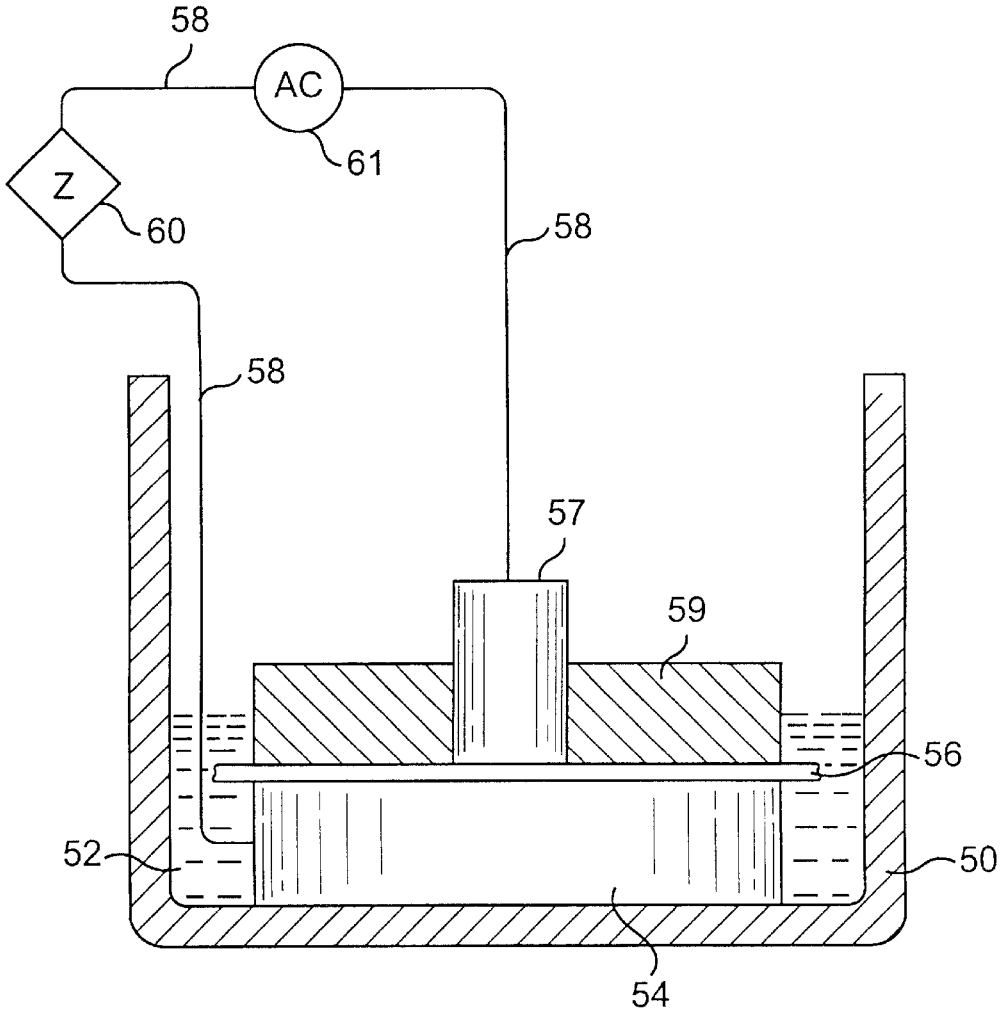
FIG. 3 is an illustration of one embodiment for determining the Diffusion Conductance Index of a paper wrapper.

For example, one test cell that can be used is illustrated in FIG. 3. As shown, the glass vessel 50 contains an electrolyte 52, such as a 0.5 molar solution of tetraethylammonium chloride in butyrolactone. A bottom electrode 54, having a diameter of about 7.6 cm, for example, supports the paper sample 56. A top electrode 57 having a diameter of about 1.4 cm, for example is placed on the paper sample 56. In some embodiments, the electrodes 54 and 57 may be made from gold-plated brass cylinders. As shown, the top electrode 57 is also surrounded by a nonconductive support 59, which can, for example, be made from Teflon (polytetrafluoroethylene). The electrodes 54 and 57 are connected by a wire 58 through an impedance bridge 60, which provides an alternating current of 1 Khz frequency. The DCI is determined by dividing the intrinsic resistivity of the solution by the product of the measured resistance and the area of paper in contact with both electrodes (in the case described, area=1.6 $cm^2$) to given units of $cm^{-1}$.

"Static Burn Rate (SBR)": The SBR is a well-known test method that is used to measure the rate a smoking article burns when ignited in ambient air. The time required for the smoking article to burn a certain length is measured and recorded. The SBR is usually represented in millimeters per minute.

DETAILED DESCRIPTION

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations and their equivalents.

In general, the present invention is directed to a method for modifying the paper wrapper of a smoking article to control the burn rate of the article. In particular, the burn rate of the smoking article may be reduced by incorporating into the paper wrapper a filler having a certain median particle size. For instance, the median particle size of the filler is typically greater than about 2.5 microns. As a result of such a reduction in burn rate, the resulting smoking articles can have less of a propensity to ignite other articles or surfaces (i.e., ignition proclivity), as well as have an increased puff count. Moreover, such improved properties can be attained in accordance with the present invention without substantially affecting other properties of the smoking article, such as the taste, tar delivery, and sidestream smoke of the wrapper.

In general, the paper wrapper of the present invention can be made from a variety of different types of materials. For example, in some embodiments, the paper wrapper can be made from cellulosic fibers obtained, for instance, from flax, softwood or hardwood fibers. Further, in order to vary the properties of the paper as desired, various mixtures of cellulosic fibers can also be used. If desired, the fibers of paper wrapper can also be refined in any conventional manner. For example, in some embodiments, the extent of refinement may range from about 5 kilorevolutions to about 20 kilorevolutions in, for example, a PFI mill. Refinement of the fibers used to form the wrapper may sometimes help control certain properties of the resulting wrapper, such as permeability, and may also affect the burn rate of the resulting smoking article.

The basis weight of wrapping papers formed according to the present invention can generally vary as desired. For example, in most applications, the paper has a basis weight of from about 18 gsm to about 40 gsm, and more particularly from about 22 gsm to about 30 gsm. In one particular embodiment, the wrapping paper has a basis weight of 28 gsm.

As stated above, in accordance with the present invention, a filler having a certain median particle size is incorporated into the paper wrapper. In particular, to reduce the burn rate of the smoking article, fillers having a relatively large median particle size can be utilized. For instance, the filler typically has a median particle size of greater than about 2.5 microns, in some embodiments between about 3 microns to about 15 microns, in some embodiments, between about 3.5 microns to about 15 microns, and in some embodiments, between about 3.5 microns to about 10 microns. As used herein, the phrase "median particle size" generally refers to the size of a filler as measured and determined by a sedimentation procedure using, for instance, a sedigraph.

The fillers may also have a variety of different shapes. For example, in some embodiments, the filler can have a scalenohedral shape, a rhomboid shape, a cubic shape, etc.

In general, any filler having the desired particle size and/or shape may be used in the wrapper of the present invention. For instance, some examples of such fillers can include, but are not limited to, calcium carbonate, titanium dioxide, magnesium carbonate, magnesium oxide, and the like. In one particular embodiment, for example, precipitated calcium carbonate is utilized as the filler. One suitable calcium carbonate filler can be obtained from Specialty Minerals, Inc. of Adams, Mass., under the tradename ADX 7014, which is a precipitated calcium carbonate material.

In making paper wrappers in accordance with the present invention, a single filler having the desired particle size may be utilized. Moreover, if desired, mixtures of differently sized and/or shaped fillers may also be used. For instance, mixtures of different larger-sized fillers may be added to the paper or a larger-sized filler may be mixed with a filler having a smaller, conventional size, so long as the burn rate of the resulting smoking article is appropriately reduced. In one embodiment, for example, a calcium carbonate filler having a relatively large particle size may be mixed with a magnesium oxide filler having a relatively low particle size.

The amount of filler(s) added to the paper generally depends upon the desired permeability and the particle size of the filler(s) used. Of particular advantage, however, the above-described burn rate levels can be obtained without substantially increasing or decreasing the filler level in the paper from conventional levels. Thus, for most applications, the total filler level in the paper can be from about 20% by weight to about 45% be weight, and in some embodiments, from about 20% by weight to about 30% by weight.

The filler(s) can generally be incorporated into the paper wrapper of the present invention using any of a variety of different well-known techniques. For example, in one embodiment, the filler is first combined with water or an aqueous solution to form a filler slurry. This slurry is added to a suspension of cellulosic fibers (e.g., flax) during the papermaking process. For instance, the fiber suspension can be formed from a cellulosic fiber furnish that has been cooked in a digester, washed, bleached, and then refined. To form the paper wrapper, the resulting slurry and fiber suspension mixture can be spread out onto a screen or a set of screens and dried. Alternatively, the filler may simply be applied as a dry powder to the cellulosic fiber furnish or web during the paper making process.

When filler(s) are incorporated into a wrapping paper in accordance with the present invention, it is believed that, at constant filler levels, due to the increase in filler particle size, the pores developed within the paper structure are larger in size, as well as fewer in number. As a result of some or all of the above-mentioned effects, it is believed that the total area of open spaces available for diffusion of air within the web structure is reduced. Moreover, the burn rate of the smoking article is generally thought to be related to the diffusion of air through the open spaces within a paper structure. Thus, because the paper structure contains a reduced area of open space, the burn rate of the paper wrapper can also be reduced.

The burn rate of a particular paper wrapper can generally be measured using a variety of techniques, such as Static Burn Rate (SBR) or Diffusion Conductance Index (DCI). For example, in most embodiments of the present invention, the DCI of the paper wrapper is less than about 15 $cm^{-1}$, in some embodiments between about 5 $cm^{-1}$ to about 15 $cm^{-1}$, and in some embodiments, between about 5 $cm^{-1}$ to about 12 $cm^{-1}$. Moreover, the SBR of the paper wrapper is typically less than about 5.0 millimeters per minute, in some embodiments less than about 4.0 millimeters per minute, and in some embodiments, between about 2.0 to about 3.5 millimeters per minute. In addition, it is believed that the paper wrappers of the present invention can provide up to about 75% of a reduction in the burn rate of a smoking article as compared to an identical smoking article made with a paper wrapper having a lower filler particle size (e.g., 1.9 microns) but the same permeability. For instance, in one embodiment, a paper wrapper of the present invention can provide up to about 50%, in some embodiments up to about 25%, and in some embodiments, between about 5% to about 20% of a reduction in the burn rate of a smoking article as compared to an identical smoking article made with a paper wrapper having a lower filler particle size. As indicated above, such a low burn rate can help reduce the ignition proclivity of a smoking article, i.e., reduced propensity to ignite surfaces or articles with which the come into contact, such as by accidental dropping and the like.

Further, such benefits can be attained in accordance with the present invention without severely affecting other properties of the smoking article, such as taste, tar delivery, sidestream smoke, and the like. For instance, the larger-sized particles can sometimes form pores that are also larger in size, which may increase the permeability of the paper. Thus, in one embodiment, the fibers within the web are refined to a certain extent so that the permeability of the web is less than about 60 CORESTA units, in some embodiments less than about 35 CORESTA units, and in some embodiments, between about 10 CORESTA units to about 35 CORESTA units. It has been surprisingly discovered that refining the fibers to such an extent does not alter the ability of the wrapper of the present invention to achieve the burn rate reduction described above.

The wrapping paper of the present invention may also be treated with a burn control additive. Such burn control additives can include, for instance, alkali metal salts, such as potassium or sodium citrate, or acidic salts, such as sodium, potassium, or monoammonium phosphates. Different types of burn control additives can also be mixed and applied to the paper. The burn control additive can be added to the paper in an amount from about 0.3% to about 16% by weight, and in one application from about 0.3% to about 3% by weight. Moreover, other additives can also be incorporated within the paper wrapper.

In some embodiments, the paper wrapper of the present invention may also be used in conjunction with other techniques for further reducing the burn rate of the smoking article. Some suitable techniques are described in U.S. Pat. Nos. 4,739,775 to Hampl, Jr.; 5,878,753 to Peterson, et al.; 5,878,754 to Peterson, et al.; 5,820,998 to Hotaling, et al.; 5,263,999 to Baldwin, et al.; and 5,417,228 to Baldwin, et al., which are all incorporated herein in their entirety by reference thereto for all purposes. For example, in some embodiments, the paper wrapper of the present invention can also be coated with discrete regions of an ignition-reducing solution. In one embodiment, for instance, an aqueous film-forming solution, such as acidified sodium alginate or a cellulosic polymer dissolved in a non-aqueous solvent, can be applied to certain portions of the paper wrapper. If desired, other additives, such as polyvalent metal cations or particulate fillers, can also be added to the solution before applying it to the wrapper. The ignition-reducing solution may generally be applied to the wrapper using conventional techniques, such as gravure or flexographic printing. Moreover, the solution can also be applied in a variety of discrete patterns, such as in the shape of bands, crosshatch, ramped, irregular shapes, and the like.

As a result of the present invention, a paper wrapper having a relatively low burn rate within a certain natural permeability range can be produced. For example, a paper wrapper of the present invention can have a DCI less than about 15 $cm^{-1}$. Such slower burn rates can result in reduced ignition proclivity and increased puff counts, and can be achieved without having a substantial affect on other characteristics of the smoking article, such as taste, sidestream smoke, etc.

The present invention may be better understood with reference to the following examples.

EXAMPLE 1

The burn rate of a smoking article made with a paper wrapper incorporating ADX 7014 calcium carbonate filler (median particle size of 3.5 microns) was compared with the burn rate of a smoking article wrapped with a paper incorporating ALBACAR 5970 calcium carbonate filler having (median particle size of 1.9 microns). Both the ADX 7014 and ALBACAR 5970 fillers were obtained from Speciality Minerals, Inc. of Adams, Mass.

All of the sample wrappers had a basis weight of about 25 gsm and a total filler loading of about 28% by weight. Moreover, the fibers within the paper wrapper were refined in a manner to achieve wrappers with varying permeabilities. Once formed, the Diffusion Conductance Index (DCI) of the wrappers was determined according to the DCI test procedure described above. The results are illustrated in FIG. 1.

From this experiment, it was discovered that the calcium carbonate filler with a 3.5-micron particle size yielded a lower DCI value at a corresponding CORESTA permeability value than the calcium carbonate filler with a 1.9-micron particle size.

EXAMPLE 2

The burn rate of a smoking article made with a paper wrapper incorporating ADX 7014 calcium carbonate filler (median particle size of 3.5 microns) was compared with the burn rate of a smoking article made with a paper wrapper incorporating ALBACAR 5970 calcium carbonate filler (median particle size of 1.9 microns). Both the ADX 7014 and ALBACAR 5970 fillers were obtained from Speciality Minerals, Inc. of Adams, Mass.

All of the sample wrappers had a basis weight of about 25 gsm and a total filler loading of about 28% by weight. Moreover, the fibers within the paper wrapper were refined in a manner to achieve wrappers with varying permeabilities. The sample set containing the ALBACAR 5970 filler was also incorporated with 0.5 wt. % citrate. Moreover, one of the sample sets containing the ADX 7014 filler was incorporated with 0.5 wt. % citrate, while the other sample set containing the ADX 7014 filler was incorporated with 0.5 wt. % monoammonium phosphate (MAP).

Figure 2:
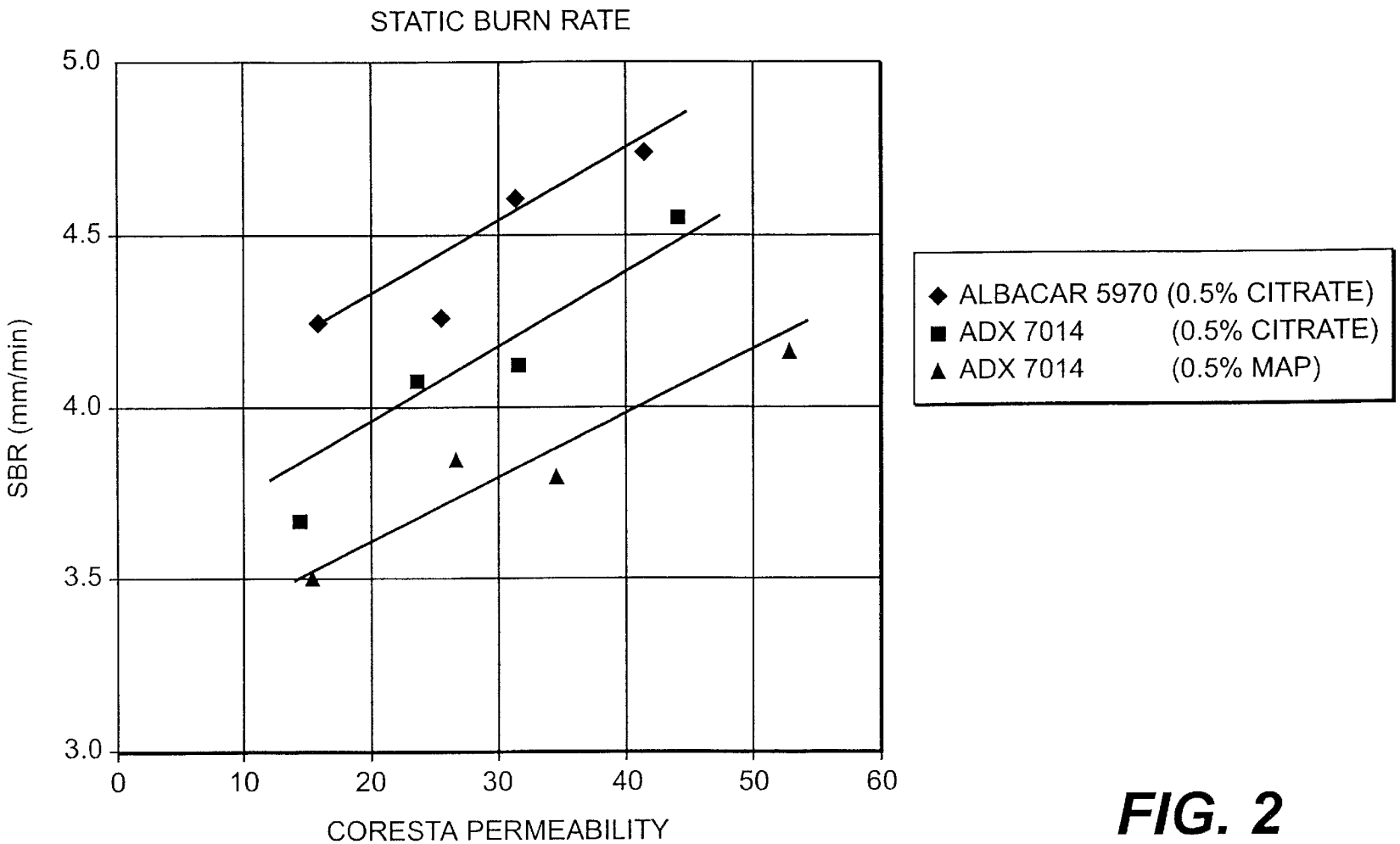
FIG. 2 is a graphical illustration of the Static Burn Rate (SBR) values for one embodiment of a paper wrapper of the present invention.

Cigarettes were then made using a laboratory cigarette maker with the above-described paper wrappers. Each of the cigarettes were lit and allowed to free burn in a static mode. As the cigarette burned, the burn rate was measured using the SBR test procedure described above. The results are illustrated in FIG. 2.

From this experiment, it was discovered that the calcium carbonate filler with a 3.5-micron particle size yielded a lower SBR value at a corresponding CORESTA permeability value than the calcium carbonate filler with a 1.9-micron particle size.

EXAMPLE 3

Various properties of smoking articles made with paper wrappers incorporating a precipitated calcium carbonate filler having median particle sizes of 1.9 microns (ALBACAR 5970), 3.5 microns (ADX 7014), 10 microns (VICRON), and 15 microns (MARBLEWHITE) were compared. ADX 7014 and ALBACAR 5970 had scalenohedral shapes, while VICRON and MARBLEWHITE had rhomboid shapes. All of the fillers were obtained from Specialty Minerals, Inc. of Adams, Mass.

Three sample wrappers A-C having a basis weight of about 30 gsm were formed using flax fibers and refined to an extent of 8 kilorevolutions (krevs), 8 krevs, and 16 krevs, respectively, in a PFI mill. In addition, Sample A had a total filler loading of about 25% by weight of the wrapper, while Samples B-C had a total filler loading of about 35% by weight of the wrapper.

Cigarettes were then made using a laboratory cigarette maker with the above-described paper wrappers. Each of the cigarettes were lit and allowed to free burn in a static mode. As the cigarette burned, the burn rate was measured using the SBR test procedure described above. The results are illustrated in Table I. In addition, the permeability was measured using well-known techniques and is illustrated in Table II.

TABLE I

Effect of Particle Size on Static Burn Rate (SBR)

| Filler | Particle Size (microns) | SBR (mm/min) Sample A | Sample B | Sample C |
|---|---|---|---|---|
| ALBACAR 5970 | 1.9 | 3.71 | 4.45 | 4.04 |
| ADX 7014 | 3.5 | 3.40 | 4.20 | 3.78 |
| VICRON | 10.0 | 2.44 | 3.51 | 3.11 |
| MARBLE-WHITE | 15.0 | 2.26 | 3.36 | 2.60 |

TABLE II

Effect of Particle Size on Permeability

| Filler | Particle Size (microns) | Permeability (CORESTA) Sample A | Sample B | Sample C |
|---|---|---|---|---|
| ALBACAR 5970 | 1.9 | 19.3 | 29.7 | 23.6 |
| ADX 7014 | 3.5 | 14.5 | 28.3 | 19.5 |
| VICRON | 10.0 | 10.4 | 17.4 | 11.7 |
| MARBLE-WHITE | 15.0 | 8.0 | 17.0 | 9.8 |

As indicated above, the paper wrappers formed with the ADX 7014, VICRON, and MARBLEWHITE fillers resulted in lower burn rates than the paper wrapper formed with the ALBACAR 5970 filler.

EXAMPLE 4

The permeability of smoking articles made with paper wrappers incorporating a scalenohedrally-shaped precipitated calcium carbonate filler having median particle sizes of 1.3 microns, 1.9 microns, 2.8 microns, 4.2 microns, and 6.1 microns were compared. In particular, three sample wrappers A-C having a basis weight of about 30 gsm and a total filler loading of about 30% by weight of the wrapper were formed using flax fibers. Samples A-C were refined to an extent of 6 krevs, 12 krevs, and 18 krevs, respectively, in a PFI mill.

Cigarettes were then made using a laboratory cigarette maker with the above-described paper wrappers. The permeability of each wrapper was then determined using well-known techniques. The results are shown below in Table III.

TABLE III

Effect of Particle Size on Permeability

| Filler Particle | Permeability (CORESTA) | | |
|---|---|---|---|
| Size (microns) | Sample A | Sample B | Sample C |
| 1.3 | 29.8 | 20.7 | 15.8 |
| 1.9 | 60.3 | 36.2 | 27.7 |
| 2.8 | 51.5 | 35.7 | 27.1 |
| 4.2 | 85.4 | 48.9 | 35.2 |
| 6.1 | 82.2 | 46.8 | 40.3 |

As indicated above, for a given level of refinement, permeability generally increased as the particle size of the filler was increased. In addition, for a given particle size, the permeability of the wrapper generally decreased as the extent of refinement was increased.

EXAMPLE 5

The burn rate of smoking articles made with paper wrappers incorporating a scalenohedrally-shaped precipitated calcium carbonate filler having median particle sizes of 1.3 microns, 1.9 microns, 2.8 microns, 4.2 microns, and 6.1 microns were compared. In particular, four sample wrappers A-D having a basis weight of about 30 gsm and a total filler loading of about 30% by weight of the wrapper were formed using flax fibers. Samples A-D had permeabilities of 20 CORESTA, 40 CORESTA, 60 CORESTA, and 80 CORESTA, respectively.

Cigarettes were then made using a laboratory cigarette maker with the above-described paper wrappers. Each of the cigarettes were lit and allowed to free burn in a static mode. As the cigarette burned, the burn rate was measured using the SBR test procedure described above. The results are shown below in Table IV. In addition, the Diffusion Conductance Index (DCI) of the wrappers A-D was determined according to the DCI test procedure described above. The DCI results are shown below in Table V.

TABLE IV

Static Burn Rate (SBR)

| Filler Particle | SBR (mm/min) | | | |
|---|---|---|---|---|
| Size (microns) | Sample A | Sample B | Sample C | Sample D |
| 1.3 | 4.1 | 4.9 | — | — |
| 1.9 | 4.0 | 4.5 | 4.9 | 5.1 |
| 2.8 | 3.7 | 4.4 | 4.8 | 5.0 |

TABLE IV-continued

Static Burn Rate (SBR)

| Filler Particle | SBR (mm/min) | | | |
|---|---|---|---|---|
| Size (microns) | Sample A | Sample B | Sample C | Sample D |
| 4.2 | 3.5 | 4.2 | 4.6 | 4.8 |
| 6.1 | 3.4 | 4.0 | 4.3 | 4.4 |

TABLE V

Diffusion Conductance Index (DCI)

| Filler Particle | DCI ($cm^{-1}$) | | | |
|---|---|---|---|---|
| Size (microns) | Sample A | Sample B | Sample C | Sample D |
| 1.3 | 14.5 | 17.5 | — | — |
| 1.9 | 12.5 | 16.5 | 18.5 | 19.5 |
| 2.8 | 11.5 | 15.0 | 17.0 | 18.0 |
| 4.2 | 9.0 | 13.5 | 15.5 | 16.5 |
| 6.1 | 8.0 | 12.5 | 14.5 | 15.5 |

Thus, as indicated above, regardless of permeability, the burn rate of the smoking articles generally decreased as the particle size of the filler particle was increased.

EXAMPLE 6

The burn rate of smoking articles made with paper wrappers incorporating a precipitated calcium carbonate filler having median particle sizes of 1.9 microns (ALBACAR 5970, scalenohedral shape), 4.2 microns (MD 4079, scalenohedral shape), and 4.5 microns (VICALITY EXTRA HEAVY, cubic shape) were compared. ALBACAR 5970 and VICALITY EXTRA HEAVY were applied as a dry powder. MD 4079 was applied as a slurry. All of the fillers were obtained from Specialty Minerals, Inc. of Adams, Mass.

Three sample wrappers A-C having a basis weight of about 30 gsm and a total filler loading of 30% by weight of the wrapper were formed using flax fibers and refined to an extent of 6 krevs, 12 krevs, and 18 krevs, respectively, in a PFI mill.

Cigarettes were then made using a laboratory cigarette maker with the above-described paper wrappers. Each of the cigarettes were lit and allowed to free burn in a static mode. As the cigarette burned, the burn rate was measured using the SBR test procedure described above. The results are shown in Table VI. In addition, the Diffusion Conductance Index (DCI) of the wrappers was determined according to the DCI test procedure described above. The results are shown in Table VII.

TABLE VI

Static Burn Rate (SBR)

| Filler | Particle Size (microns) | SBR (mm/min) Sample A | Sample B | Sample C |
|---|---|---|---|---|
| ALBACAR 5970 | 1.9 | 4.44 | 3.95 | 3.95 |
| MD 4079 | 4.2 | 4.07 | 3.83 | 3.60 |
| VICALITY EXTRA HEAVY | 4.5 | 3.93 | 3.66 | 3.38 |

TABLE VII

| Diffusion Conductance Index (DCI) | | | | |
|---|---|---|---|---|
| | Particle Size | DCI ($cm^{-1}$) | | |
| Filler | (microns) | Sample A | Sample B | Sample C |
| ALBACAR 5970 | 1.9 | 13.99 | 13.69 | 11.84 |
| MD 4079 | 4.2 | 12.53 | 13.92 | 11.07 |
| VICALITY EXTRA HEAVY | 4.5 | 12.17 | 11.28 | 10.07 |

As indicated above, for a given level of refinement, the smoking articles formed with the MD 4079 and VICALITY EXTRA HEAVY fillers generally had lower burn rates than the smoking article formed with the ALBACAR 5970 filler.

EXAMPLE 7

The burn rate of smoking articles made with paper wrappers incorporating a precipitated calcium carbonate filler having median particle sizes of 3.2 microns (ADX 7014, scalenohedral shape), 4.5 microns (VICALITY EXTRA HEAVY, cubic shape), and 12 microns (VICALITY ULTRA HEAVY, cubic shape) were compared. All of the fillers were obtained from Specialty Minerals, Inc. of Adams, Mass. and applied as a dry powder.

Three sample wrappers A-C having a basis weight of about 30 gsm and a total filler loading of 30% by weight of the wrapper were formed using flax fibers and refined to an extent of 6 krevs, 12 krevs, and 18 krevs, respectively, in a PFI mill.

Cigarettes were then made using a laboratory cigarette maker with the above-described paper wrappers. Each of the cigarettes were lit and allowed to free burn in a static mode. As the cigarette burned, the burn rate was measured using the SBR test procedure described above. The results are shown in Table VIII. In addition, the Diffusion Conductance Index (DCI) of the wrappers was determined according to the DCI test procedure described above. The results are shown in Table IX.

TABLE VIII

| Static Burn Rate (SBR) | | | | |
|---|---|---|---|---|
| | Particle Size | SBR (mm/min) | | |
| Filler | (microns) | Sample A | Sample B | Sample C |
| ADX 7014 | 3.2 | 3.89 | 3.84 | 3.38 |
| VICALITY EXTRA HEAVY | 4.5 | 3.65 | 3.46 | 3.47 |
| VICALITY ULTRA HEAVY | 12.0 | 2.73 | 2.54 | 2.28 |

TABLE IX

| Diffusion Conductance Index (DCI) | | | | |
|---|---|---|---|---|
| | Particle Size | DCI ($cm^{-1}$) | | |
| Filler | (microns) | Sample A | Sample B | Sample C |
| ADX 7014 | 3.2 | 12.00 | 11.32 | 9.24 |
| VICALITY EXTRA HEAVY | 4.5 | 10.47 | 10.28 | 9.37 |

TABLE IX-continued

| Diffusion Conductance Index (DCI) | | | | |
|---|---|---|---|---|
| | Particle Size | DCI ($cm^{-1}$) | | |
| Filler | (microns) | Sample A | Sample B | Sample C |
| VICALITY ULTRA HEAVY | 12.0 | 7.50 | 7.08 | 6.16 |

As indicated above, for a given level of refinement, the burn rate of the paper wrappers generally decreased as the filler particle size was increased.

Although various embodiments of the invention have been described using specific terms, devices, and methods, such description is for illustrative purposes only. The words used are words of description rather than of limitation. It is to be understood that changes and variations may be made by those of ordinary skill in the art without departing from the spirit or scope of the present invention, which is set forth in the following claim. In addition, it should be understood that aspects of the various embodiments may be interchanged both in whole or in part. Therefore, the spirit and scope of the appended claim should not be limited to the description of the preferred versions contained therein.

What is claimed is:

1. A paper wrapper for use in a smoking article, said wrapper comprising:

a base web containing cellulosic fibers, said base web being incorporated with a filler consisting essentially of particles having a median particle size greater than about 2.5 microns, said base web having a total filler loading in an amount from about 20% to about 45% by weight of said web, a basis weight of from about 18 gsm to about 40 gsm, and a permeability of less than about 35 CORESTA; and wherein said paper wrapper has a Diffusion Conductance Index (DCI) less than about 15 $cm^{-1}$.

2. A paper wrapper as defined in claim 1, wherein said filler has a median particle size of from about 3 microns to about 15 microns.

3. A paper wrapper as defined in claim 1, wherein said filler has a median particle size of from about 3.5 microns to about 15 microns.

4. A paper wrapper as defined in claim 1, wherein said base web has a total filler loading in an amount from about 20% to about 30% by weight of said web.

5. A paper wrapper as defined in claim 1, wherein said filler comprises precipitated calcium carbonate.

6. A paper wrapper as defined in claim 1, wherein said paper wrapper has a permeability of between about 10 CORESTA units to about 35 CORESTA units.

7. A paper wrapper as defined in claim 1, wherein said paper wrapper has a DCI between about 5 $cm^{-1}$ to about 15 $cm^{-1}$.

8. A paper wrapper as defined in claim 1, wherein said paper wrapper has a DCI between about 5 $cm^{-1}$ to about 12 $cm^{-1}$.

9. A paper wrapper as defined in claim 1, wherein said paper wrapper has a Static Burn Rate (SBR) less than about 5 millimeters per minute.

10. A paper wrapper as defined in claim 1, wherein said paper wrapper has a Static Burn Rate (SBR) less than about 4 millimeters per minute.

11. A paper wrapper as defined in claim 1, wherein said paper wrapper has a Static Burn Rate (SBR) between about 2 to about 3.5 millimeters per minute.

12. A paper wrapper as defined in claim 1, wherein said filler has a scalenohedral shape.

13. A paper wrapper as defined in claim 1, wherein said filler has a rhomboid shape.

14. A paper wrapper as defined in claim 1, wherein said filler has a cubic shape.

15. A paper wrapper as defined in claim 1, wherein said cellulosic fibers are refined to an extent between about 5 kilorevolutions to about 20 kilorevolutions.

16. A paper wrapper as defined in claim 1, wherein said wrapper is coated with discrete regions of an ignition-reducing solution.

17. A paper wrapper for use in a smoking article, said wrapper comprising:

a base web containing cellulosic fibers, said base web being incorporated with a filler consisting essentially of particles having a median particle size greater than about 2.5 microns, said base web having a total filler loading in an amount from about 20% to about 45% by weight of said web, a basis weight of from about 18 gsm to about 40 gsm, and a permeability of less than about 35 CORESTA; and wherein said paper wrapper has a Static Burn Rate (SBR) less than about 5 millimeters per minute.

18. A paper wrapper as defined in claim 17, wherein said filler has a median particle size of from about 3 microns to about 15 microns.

19. A paper wrapper as defined in claim 17, wherein said filler has a median particle size of from about 3.5 microns to about 15 microns.

20. A paper wrapper as defined in claim 17, wherein said base web has a total filler loading in an amount from about 20% to about 30% by weight of said web.

21. A paper wrapper as defined in claim 17, wherein said filler comprises precipitated calcium carbonate.

22. A paper wrapper as defined in claim 17, wherein said paper wrapper has a permeability of between about 10 CORESTA units to about 35 CORESTA units.

23. A paper wrapper as defined in claim 17, wherein said paper wrapper has a Diffusion Conductance Index (DCI) between about 5 $cm^{-1}$ to about 15 $cm^{-1}$.

24. A paper wrapper as defined in claim 17, wherein said paper wrapper has a Diffusion Conductance Index (DCI) between about 5 $cm^{-1}$ to about 12 $cm^{-1}$.

25. A paper wrapper as defined in claim 17, wherein said paper wrapper has a SBR less than about 4 millimeters per minute.

26. A paper wrapper as defined in claim 17, wherein said paper wrapper has a SBR between about 2 to about 3.5 millimeters per minute.

27. A paper wrapper as defined in claim 17, wherein said filler has a scalenohedral shape.

28. A paper wrapper as defined in claim 17, wherein said filler has a rhomboid shape.

29. A paper wrapper as defined in claim 17, wherein said filler has a cubic shape.

30. A paper wrapper as defined in claim 17, wherein said cellulosic fibers are refined to an extent between about 5 kilorevolutions to about 20 kilorevolutions.

31. A paper wrapper as defined in claim 17, wherein said wrapper is coated with discrete regions of an ignition-reducing solution.

32. A smoking article comprising:

a column of tobacco; and a paper web wrapped around said column of tobacco, said paper web containing cellulosic fibers, said paper web being incorporated with a calcium carbonate filler consisting essentially of calcium carbonate particles having a median particle size of from about 3.5 microns to about 15 microns, said paper web having a total filler loading in an amount from about 20% to about 45% by weight of said web, a basis weight of from about 18 gsm to about 40 gsm, and a permeability of less than about 35 CORESTA; and wherein said paper web has a Static Burn Rate (SBR) between about 2 to about 3.5 millimeters per minute and a Diffusion Conductance Index (DCI) between about 5 $cm^{-1}$ to about 12 $cm^{-1}$.

33. A smoking article as defined in claim 32, wherein said filler has a shape selected from the group consisting of scalenohedral, rhomboid, cubic, and combinations thereof.

34. A smoking article as defined in claim 32, wherein said cellulosic fibers are refined to an extent between about 5 kilorevolutions to about 20 kilorevolutions.

35. A method of forming a smoking article comprising:

providing an aqueous suspension of cellulosic fibers;

refining said cellulosic fibers;

forming a base web from said cellulosic fibers, said base web having a basis weight of between about 18 grams per square meter to about 40 grams per square meter and permeability of less than about 35 CORESTA;

reducing the burn rate of the smoking article by incorporating into said base web a filler consisting essentially of particles having a median particle size greater than about 2.5 microns, said filler being incorporated in an amount such that said filler constitutes between about 20% to about 45% by weight of said base web, wherein said smoking article has a Diffusion Conductance Index of less than about 15 $cm^{-1}$ and a Static Burn Rate (SBR) less than about 5 millimeters per minute; and wrapping said base web around a column of tobacco.

* * * * *